United States Patent [19]

D'Andrade

[11] Patent Number: 4,706,848

[45] Date of Patent: Nov. 17, 1987

[54] HIGH EFFICIENCY BATTERY OPERATED WATER GUN

[76] Inventor: Bruce M. D'Andrade, 3 Ten Eyck Rd., Whitehouse Station, N.J. 08889

[21] Appl. No.: 915,418

[22] Filed: Oct. 6, 1986

[51] Int. Cl.[4] ..... A63H 3/18; B65D 88/54

[52] U.S. Cl. ..... 222/79; 222/333; 222/340; 239/99; 239/331; 417/471

[58] Field of Search ..... 239/99, 101, 331; 417/415, 471; 222/78–79, 333, 336, 340, 383

[56] References Cited

U.S. PATENT DOCUMENTS

| | | | |
|---|---|---|---|
| 2,951,556 | 9/1960 | Jackson et al. | 417/471 |
| 3,116,855 | 1/1964 | Thomson | 222/79 X |
| 4,022,350 | 5/1977 | Amron | 222/79 |
| 4,154,375 | 5/1979 | Bippus | 222/325 |
| 4,162,037 | 7/1979 | Koyama | 239/332 |
| 4,239,129 | 12/1980 | Esposito | 222/79 |

FOREIGN PATENT DOCUMENTS

| | | | |
|---|---|---|---|
| 1243801 | 9/1960 | France | 417/471 |

*Primary Examiner*—Joseph J. Rolla
*Assistant Examiner*—Michael S. Huppert
*Attorney, Agent, or Firm*—Kenneth P. Glynn

[57] ABSTRACT

The present invention is directed to a toy water gun which is battery operated. The present invention water gun has a housing which has a general configuration of a gun with a barrel and a handle. A water reservoir is located within the housing and a battery operated pumping system is also located within the housing. In addition, there is a pick up tube and a water tube, one being connected to an intake valve and the other being connected to the exhaust valve of the pumping system. The water tube which is connected to the exhaust valve is connected to a spray nozzle at its opposite end which is attached to the end of the barrel of the housing of the gun. A battery chamber is also located within the housing and electric circuitry is included which connects the battery chamber to the drive motor and to a switch which is connected to a trigger on the gun. The battery operated pumping system has a drive motor, a gear system, a drive shaft, a cam, a spring-loaded push rod, a main spring, an intake valve and an exhaust valve. Uniquely, the cam is a step-function drop off cam which operates to load the push rod and a main spring and then releases these so that the main spring operates the push rod to do the primary work of the piston within the pump system.

16 Claims, 3 Drawing Figures

HIGH EFFICIENCY BATTERY OPERATED WATER GUN

BACKGROUND OF THE INVENTION

1. Field of the Invention

The present invention is directed in general to toy water guns and more particularly is directed to battery operated toy water guns having a high efficiency low electrical energy capability which produces spurts of water by single trigger action.

2. Prior Art Statement

Toy water guns historically depend for their operation upon trigger actuated mechanical pumping systems and they typically produce continuous streams of water for a period of time which corresponds with the actuation of the trigger and the degree of pressure produced by that actuation. Thus, it is necessary with the toy water gun to produce a plurality of trigger actuations in order to generate a series of shots or spurts of water. This not only quickly tires the user but it also causes considerable wear on the mechanical aspects of the water gun.

Some prior art toy water guns are battery operated and these are directed to the production of a series of spurts by single pull of the trigger. U.S. Pat. No. 4,022,350 by Alan B. Amron, which issued on May 10, 1976, represents the state of the art of battery operated water guns. In that patent, water pistols are shown which involve direct drive, battery operated, motor driven pumping systems as well as water machine guns which are trigger actuated, battery operated, motor driven pump systems using intervening cams. However, due to the particular arrangements of the proposed cam in this prior art patent, considerable electrical power requirements are necessary in order to drive a reciprocating piston. The present invention is directed to overcoming the shortcomings of this prior art which requires considerable power.

SUMMARY OF THE INVENTION

The present invention is directed to a toy water gun which is battery operated. The present invention water gun has a housing which has a general configuration of a gun with a barrel and a handle. A water reservoir is located within the housing and a battery operated pumping system is also located within the housing. In addition, there is a pick up tube and a water tube, one being connected to an intake valve and the other being connected to the exhaust valve of the pumping system. The water tube which is connected to the exhaust valve is connected to a spray nozzle at its opposite end which is attached to the end of the barrel of the housing of the gun. A battery chamber is also located within the housing and electric circuitry is included which connects the battery chamber to the drive motor and to a switch which is connected to a trigger on the gun. The battery operated pumping system has a drive motor, a gear system, a drive shaft, a cam, a spring-loaded push rod, a main spring, an intake valve and an exhaust valve. Uniquely, the cam is a step-function drop off cam which operates to load the push rod and a main spring and then releases these so that the main spring operates the push rod to do the primary work of the piston within the pump system.

BRIEF DESCRIPTION OF THE DRAWINGS

The present invention may be more fully understood when taken in conjunction with the description below and the accompanying drawings, wherein.

DETAILED DESCRIPTION OF THE PRESENT INVENTION

Figure 1:
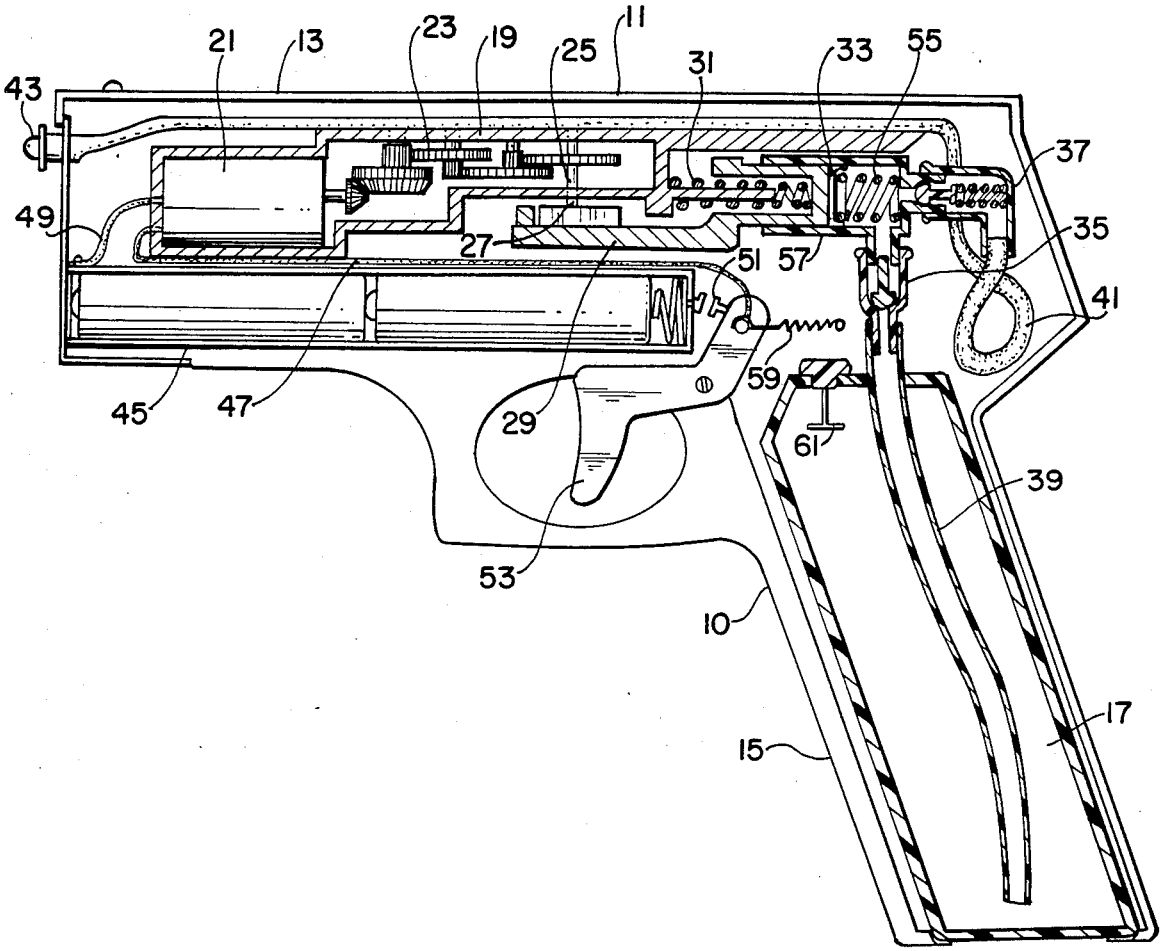
FIG. 1 is a side cut view of a preferred water gun of the present invention.

The present invention is, as mentioned, directed to a toy water gun which is battery operated. The toy water gun of the present invention may take on any configuration such as that of a pistol such as a Luger, a revolver, a Western-type colt pistol, a machine gun, an "Uzi" machine pistol, a space pistol, a rifle, or the like. The toy water gun of the present invention has a housing which has the external appearance of a gun which includes a barrel and a handle. A water reservoir is located in the housing which may be removable and, e.g., in the form of a bullet clip or permanent with an access stopper for filling the water gun with water. It also has a battery operated pumping system located in the housing as well as a pick up tube connected to an intake valve and connected to the water reservoir and a water tube which acts as an outlet tube which is connected at the exhaust valve of the pump system at one end to a spray nozzle at the other end, the spray nozzle being located at the outer tip of the barrel of the toy water gun housing. In addition there is a battery chamber located within the housing, an electrical circuitry connected to a drive motor which is part of the pumping system and to the battery chamber and includes an open circuit/closed circuit switch, as well as a trigger which is connected to the housing and to the aforesaid circuit switch. The battery operated pumping system which is located in the housing has a number of components including a drive motor, a gear system which runs from the drive motor to a drive shaft, a cam which is driven by said drive shaft, a push rod and a main spring, a piston and an intake valve and an exhaust valve. The cam is necessarily a step-function drop off type cam which is capable of loading the push rod and releasing the push rod at the drop off point. This is accomplished by the cam moving both the push rod and at the same time compressing a main spring and then, at the drop off, releasing both of these such that the main spring drives the push rod through the spring action. It is this particular feature that is critical to the present invention and is significantly unobvious over the prior art.

With respect to the prior art, a conventional method of a crank pin and a connecting rod is used to create the reciprocating motion for a piston pump. The cam is driven at a speed directly from a motor which is driven by battery energy. When this conventional method of a crank pin and connecting rod is used, a 180° turn is required in approximately 0.16 of a second or 360° in 0.32 seconds. That is, the conventional method requires rotation of the cam at approximately 180 revolutions per minute in order to generate a sufficient stroke so as to create significant enough pressure in a quick enough time to get a reasonable shot of water. Thus, in the conventional method 180° of the stroke is for compression and for shooting the water and the other 180° of the cycle is used in the return and intake phase of the cycle. It has been established that an acceptable water gun shot consists of shooting approximately 0.1 cubic inches of water through a 1.32 of an inch diameter nozzle in about 0.16 seconds. It is on this basis that the conventional system has been determined to generate approximately three spurts or shots per second. However, testing by the present inventor has established that exerting the force for an acceptable shot of water as just defined at three times per second results in a relatively short battery life. In other words, the prior art system uses significant energy for both the return and intake phase of the cycle and for the compression and shooting phase of the cycle. Since the amount of energy required for an acceptable shot could not be appreciably reduced due to the linear energy requirements and the total energy requirements of the prior art system it was perceived by the present inventor that the reduction in the number of shots per second could result in a significantly longer battery life. However, using the conventional pin and slot cam system or the conventional connecting rod and crankshaft system, which work virtually continuously throughout the cycle, merely slowing down the crank action would not work because this would also slow down the rate at which the water went through the nozzle making the spurt or shot unacceptable and in fact somewhat of a dribbling or drooping squirt. In addition, the current drain and amperes becomes very important when AA batteries or any other small battery system is used. For example, an AA alkaline cell will last for about 6 minutes utilizing 1.2 amperes, but reducing the current to approximately half that or 0.55 amperes will result in the battery lasting on average approximately nine times as long or for 54 minutes. Thus, a dual objective was unexpectedly found to be helpful, namely, reduction in the number of shots per minute, but with the same amount of power shooting the shots so as to eliminate unacceptable squirting, coupled with lowering the current requirements to achieve this end.

Since the problem could not be solved in any manner by simply changing the parameters of the conventional system, it was surprisingly discovered that a spring could be caught which would store the energy required to shoot an acceptable shot and that with this method the variable of the rate at which the spring is cocked could be slowed down without effecting the shot. Thus, cocking slowly requires less energy, produces longer battery life and reduces the number of squirts per second without decreasing the quality of the squirt itself. This is achieved be a step-function drop off cam which is described in conjunction with FIG. 2 below, but which is a rise type cam which rotates such that its peripheral edge or radius increases throughout the rotation and then in a single step-function drops off to a very short radius. This cam, when used in conjunction with a push rod connected thereto, can be used through its rotation to first slowly cock the spring-loaded push rod and then, at the point where the push rod pin or contact reaches the drop off point, the loaded spring and cam are released so that the compressed energy of the spring is used to push the piston and create the squirt of water. Ideally, the spring is cocked by a non-uniform rise cam so that the first section or earlier portion of the cam has a rapid rise because this is where there is minimum spring pressure and the later section of the cam has a slow rise to compensate for the increased load exerted by the spring and the amount of energy necessary to complete it being cocked. Thus, 270° of rotation of the cam is used to cock the spring and the remaining 90° of rotation of the spring is merely release time wherein the spring pushes the piston with the desired energy to achieve the shot or squirt of water. As a result of this particular combination of components and inner workings of the present invention water gun, all of the heretofore unachievable objectives are achieved and, is believed for the first time, a toy water gun which is battery operated can be made which will have satisfactory squirt quality, yet will have a considerable battery life due to reduced energy requirements.

Referring now to FIG. 1, there is shown toy water gun 10 which includes housing 11 having the general external appearance of a gun as shown. Housing 11 has a barrel 13 and a handle 15. Removable water reservoir 17 is located within handle 15 and battery operated pumping system 19 is located within housing 11.

The battery operated pumping system 19 in this particular embodiment includes drive motor 21, gear system 23 which is connected at one end to drive motor 21 and at the other end to drive shaft 25. Drive shaft 25 is drivable from and movably connected to gear system 23 at one end and at its opposite end has cam 27. Cam 27 is connected to drive shaft 25, as shown, and is also connected to spring loaded push rod 29. The drive shaft 25 drives cam 27 and in turn moves spring-loaded push rod 29 which "cocks" or loads both spring-loaded push rod 29 and its main spring 31. This will be discussed in more detail in conjunction with FIG. 2 below. The spring-loaded push rod 29 is connected to piston 33 merely by being contiguous thereto and by a return spring 55 which acts to hold piston 33 against the end of spring-loaded push rod 29. Also included are intake valve 35 and exhaust valve 37 which are connected to the piston and located within pump housing 57 so as to create a pump.

Pick up tube 39 is connected at one end to intake valve 35 and at the other end freely rests within water reservoir 17. At exhaust valve 37, water tube 41 runs therefrom to the tip of the barrel 13 and is connected at that location to spray nozzle 43. Battery chamber 45 is also located in barrel 13 as shown and has electrical wires which include electrical circuitry wire 47 and electrical circuitry wire 49 which are connected at one end to the battery chamber 45 and at the other end to drive motor 21, and again, at one end to trigger 53 and the other end at drive motor 21, respectively. Trigger 53 is located as shown and is connected to open circuit/closed circuit switch 51 and this along with the trigger is kept in the open position via trigger spring 59. Reservoir plug 61 is located on the top of reservoir 17, and filling is accomplished after the reservoir 17 is removed from handle 15.

As can be seen, when trigger 53 is pulled and there are batteries in battery chamber 45, the electrical circuitry is completed within the battery, drive motor 21 is operated so as to drive the gear system 23 and drive shaft 25, as well as cam 27. Cam 27 rotates and cycles so as to move push rod 29 back into the loaded position and tightens main spring 31. As the cam continues through its cycle at its step-function drop off point, the push rod 29 is rapidly released by the force of main spring 31 thereby driving piston 33 and pumping water from reservoir 17 through pick up tube 39 and intake valve 35 and through exhaust valve 37 and water tube 41 and ultimately through spray nozzle 43 to create a squirt of water. If trigger 53 is held closed the cam 27 cycles through a number of rotations and causes repeated squirts through spray nozzle 43 at even intervals.

Figures 2, 3:
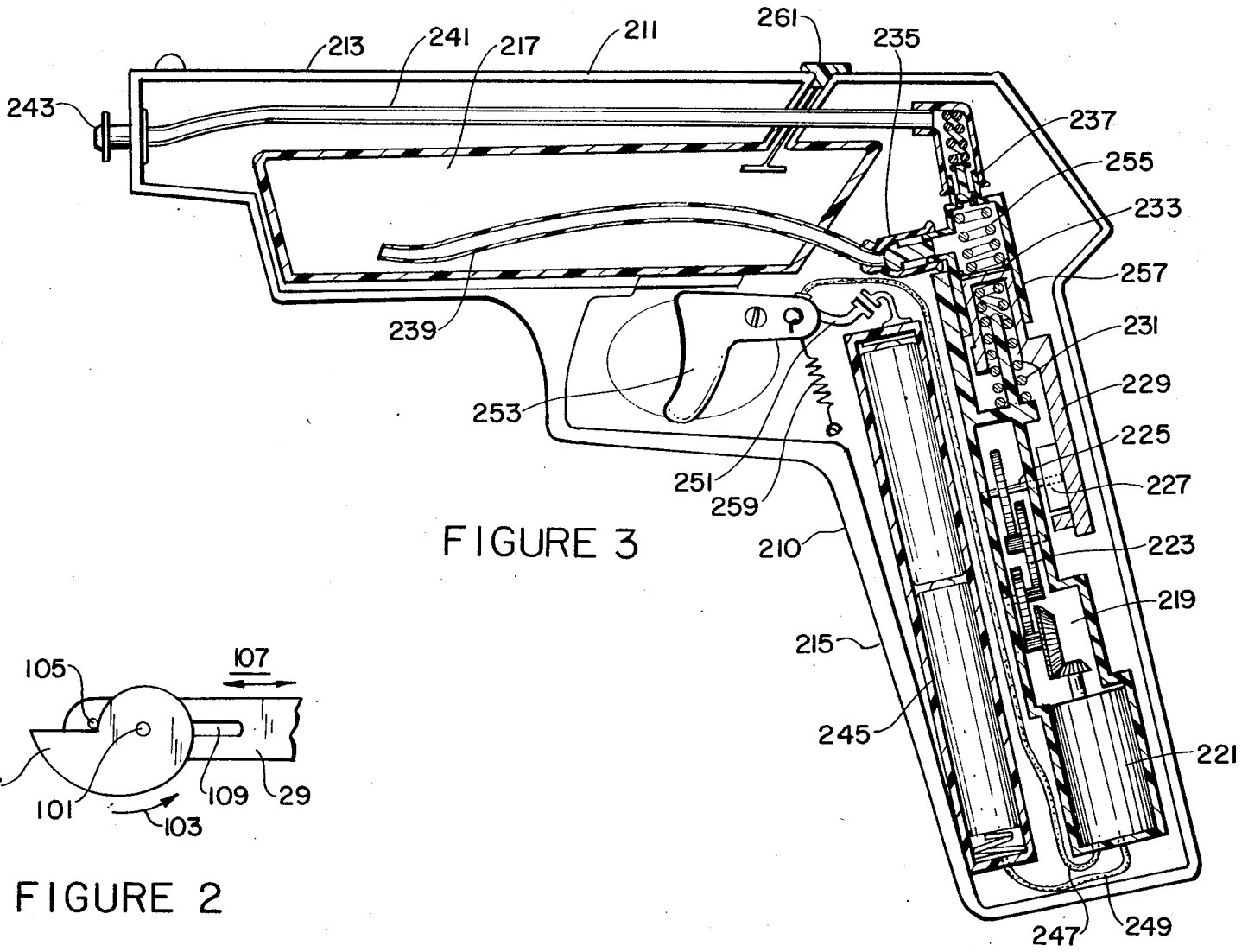
FIG. 2 is a top view of a step-function drop off cam and part of a push rod which are preferred features of the present invention water gun; and, FIG. 3 is a side cut view of an alternative preferred water gun of the present invention.

Referring now to FIG. 2, there is shown a top blown view of cam 27 and push rod 29 (in part). Push rod 29 is capable of moving back and forth along arrow 107 shown in FIG. 2. Push rod 29 has a pin 105 which is located in alignment with the center of cam 27 which has its screw 101 screwed into drive shaft 25 (not shown). Slot 109 in push rod 29 allows push rod 29 to move back and forth along the path shown by arrow 107. This movement is achieved by the rotation of cam 27 as shown by arrow 103. Cam 27 is a step-function drop off type cam and as it rotates through a cycle, push rod 29 is first slowly moved to the left, whereby main spring 31 (shown in FIG. 1) is loaded, and as cam 27 completes its cycle and pin 105 drops off at the drop off point, both spring-loaded push rod 29 and main spring 31 are released to create the pumping action. Ideally, and in this particular embodiment, cam 27 has and early rapid rise and a later slow rise before the drop off point so as to reduce energy requirements. Thus, this toy water gun 10 may be operated with two AA size batteries and this can be done very efficiently with considerably longer periods of operation time as compared to the prior art, e.g. 400% to 500% increase. Referring now to FIG. 3, there is shown toy water gun 210 with all other parts being numbered the same as those parts for FIG. 1 except that a digit 2 is placed in front of each number. The following is a list of parts identified by FIG. 3:

| Number | FIG. 3 COMPONENTS<br>Component |
|---|---|
| 210 | Toy Water Gun |
| 211 | Housing |
| 213 | Barrel |
| 215 | Handle |
| 217 | Water Reservoir |
| 219 | Battery Operated Pumping System |
| 221 | Drive Motor |
| 223 | Gear System |
| 225 | Drive Shaft |
| 227 | Cam |
| 229 | Spring-Loaded Push Rod |
| 231 | Main Spring |
| 233 | Piston |
| 235 | Intake Valve |
| 237 | Exhaust Valve |
| 239 | Pick Up Tube |
| 241 | Water Tube |
| 243 | Spray Nozzle |
| 245 | Battery Chamber |
| 247 | Electrical Circuitry Wire |
| 249 | Electrical Circuitry Wire |
| 251 | Open Circuit/Closed Circuit Switch |
| 253 | Trigger |
| 255 | Return Spring |
| 257 | Pump Housing |
| 259 | Trigger Spring |
| 261 | Reservoir Plug |

All of the above elements function essentially as they do with respect to FIG. 1 except that in this embodiment the moving parts are located in the handle 215 and the water reservoir is located in barrel 213.

Obviously, numerous modifications and variations of the present invention are possible in light of the above teachings. It is therefore understood that within the scope of the appended claims, the invention may be practiced otherwise than as specifically described herein.

What is claimed is:

1. A toy water gun which comprises:

(a) a housing having the external appearance of a gun which includes a barrel and a handle;

(b) a water reservoir located within said housing;

(c) a battery operated pumping system located in said housing, which includes:

(i) a drive motor;

(ii) a gear system connected at one end to said drive motor and at the other end to a drive shaft;

(iii) a drive shaft being drivable from and movably connected to said gear system at one end and connected to a cam at its opposite end;

(iv) a cam connected to said drive shaft and being drivable thereby and being movably connected to a spring-loaded push rod said cam being a step-function drop off cam capable of loading said push rod and releasing said push rod in a step-function drop off fashion such that spring action will drive said push rod;

(v) a spring-loaded push rod movably connected to said cam at one end and loadable thereby and connected to a piston at its opposite end;

(vi) a main spring having adequate tension upon loading and release to drive said push rod;

(vii) a piston movably connected to said push rod; and, (viii) an intake valve and an exhaust valve connected to said piston, thereby creating a pump;

(d) a pickup tube connected to said intake valve at one end and connected to said water reservoir at the other end;

(e) a water tube connected at one end to the exhaust valve and at the other end to a spray nozzle;

(f) a spray nozzle attached to said water tube and located at the end of the barrel of said housing;

(g) a battery chamber located within said housing;

(h) electrical circuitry connected to said drive motor and to said battery chamber and including an open circuit/close circuit switch;

(i) a trigger movably connected to said housing and further connected to said open circuit/closed circuit switch;

such that when water is placed within said water reservoir, and batteries are placed within said battery chamber and the trigger is pulled, the electrical circuitry is completed within the battery, the aforesaid motor is operated, the motor drives said gears and driveshaft, said cam is rotated and cycled so as to move said push rod back and load same by closing said spring, and upon cycling through its step function drop off, releasing said push rod and spring such that said spring drives said push rod forward, so as to create a pumping action and so as to pump water from said water reservoir through said intake valve, through said exhaust valve, through said water tube and through said nozzle to create a series of spurts of water drawn from the reservoir and out the end of the nozzle in a repeating water gun fashion.

2. The toy water gun of claim 1 wherein said battery operated pumping system is operable with batteries having approximately three volts.

3. The toy water gun of claim 2 wherein the battery chamber is structured to receive two batteries of AA size.

4. The toy water gun of claim 1 wherein said step-function drop off cam is a non-uniform vise cam having an early rapid rise and a later slower rise before drop off to reduce energy requirements.

5. The toy water gun of claim 1 wherein said toy gun is a pistol.

6. The toy water gun of claim 5 wherein said water reservoir is located in the handle of said housing and said pumping system is located in the barrel of said housing.

7. The toy water gun of claim 5 wherein said water reservoir is located in the barrel of said housing and said pumping system is, at least in part, located in said handle.

8. A toy water gun which comprises:

(a) a housing having the external appearance of a gun which includes a barrel and a handle;

(b) a water reservoir located within said housing;

(c) a battery operated pumping system located in said housing, which includes:

(i) a drive motor;

(ii) a gear system connected at one end to said drive motor and at the other end to a drive shaft;

(iii) a drive shaft being drivable from and movably connected to said gear system at one end and connected to a cam at its opposite end;

(iv) a cam connected to said drive shaft and being drivable thereby and being movably connected to a spring-loaded push rod said cam being a step-function drop off cam capable of loading said push rod and releasing said push rod in a step-function drop off fashion such that spring action will drive said push rod;

(v) a spring-loaded push rod movably connected to said cam at one end and loadable thereby and connected to a piston at its opposite end;

(vi) a main spring having adequate tension upon loading and release to drive said push rod;

(vii) a piston movably connected to said push rod; and, (viii) an intake valve and an exhaust valve connected to said piston, thereby creating a pump;

(ix) a return spring which is connected to said piston and pushes the piston against said push rod towards said cam so as to aid in the loading of said push rod and main spring and so as to reduce the electrical energy requirements;

(d) a pickup tube connected to said intake valve at one end and connected to said water reservoir at the other end;

(e) a water tube connected at one end to the exhaust valve and at the other end to a spray nozzle;

(f) a spray nozzle attached to said water tube and located at the end of the barrel of said housing;

(g) a battery chamber connectively located to said housing;

(h) electrical circuitry connected to said drive motor and to said battery chamber and including an open circuit/close circuit switch;

(i) a trigger movably connected to said housing and further connected to said open circuit/closed circuit switch;

such that when water is placed within said water reservoir, and batteries are placed within said battery chamber and the trigger is pulled, the electrical circuitry is completed within the battery, the aforesaid motor is operated, the motor drives said gears and driveshaft, said cam is rotated and cycled so as to move said push rod back and load same by closing said spring, and upon cycling through its step-function drop off, releasing said push rod and spring such that said spring drives said push rod forward, so as to create a pumping action and so as to pump water from said water reservoir through said intake valve, through said exhaust valve, through said water tube and through said nozzle to create a series of spurts of water drawn from the reservoir and out the end of the nozzle in a repeating water gun fashion.

9. The toy water gun of claim 8 wherein said battery operating pump system is operable with batteries having approximately three volts.

10. The toy water gun of claim 9 wherein the battery chamber is structured to receive two batteries of AA size.

11. The toy water gun of claim 8 wherein said step-function drop off cam is a non-uniform vise cam having an early rapid rise and a later slower rise before drop off to reduce energy requirements.

12. The toy water gun of claim 11 wherein said cam is a non-uniform step-function drop off cam.

13. The toy water gun of claim 8 wherein said toy gun is a pistol.

14. The toy water gun of claim 13 wherein said water reservoir is located in the handle of said housing and said pumping system is located in the barrel of said housing.

15. The toy water gun of claim 13 wherein said water reservoir is located in the barrel of said housing and said pumping system is, at least in part, located in said handle.

16. The toy water gun of claim 8 wherein said cam is a non-uniform step-function drop off cam.

* * * * *